United States Patent [19]

Johansson

[11] 4,423,656

[45] Jan. 3, 1984

[54] FRAME CONSTRUCTION FOR STRING INSTRUMENTS

[76] Inventor: Leif S. Johansson, Gruvgalan 11, Atvidaberg, Sweden

[21] Appl. No.: 316,296

[22] Filed: Oct. 29, 1981

Related U.S. Application Data

[63] Continuation of Ser. No. 174,524, filed as PCT SE/00079, Apr. 2, 1979, published as WO 79/00891, Nov. 1, 1979, § 102(e) date Nov. 5, 1979, abandoned.

[30] Foreign Application Priority Data

Apr. 6, 1978 [SE] Sweden ..... 7803867

[51] Int. Cl.[3] ..... G10C 3/08

[52] U.S. Cl. ..... 84/188; 84/197; 84/285; 84/292; 84/297 R

[58] Field of Search ..... 84/173–176, 84/189–190, 197–198, 264–265, 285, 290–292, 294–295, 297 R, 256–258

[56] References Cited

U.S. PATENT DOCUMENTS

| | | | |
|---|---|---|---|
| 481,035 | 8/1892 | Kempton | 84/189 |
| 2,813,448 | 11/1957 | Robinson | 84/297 R |

FOREIGN PATENT DOCUMENTS

| | | | |
|---|---|---|---|
| 164987 | 9/1953 | Australia | 84/173 |
| 50094 | 5/1911 | Austria | 84/285 |
| 320270 | 12/1902 | France | 84/257 |
| 1116966 | 5/1956 | France | 84/173 |

*Primary Examiner*—Lawrence R. Franklin
*Attorney, Agent, or Firm*—Hayes, Davis & Soloway

[57] ABSTRACT

The invention relates to a modular frame construction for string instruments. Instead of making the frame of the string instrument in one piece, the frame according to this invention is assembled from a number of modules which each comprise a longitudinal tubular member of square cross-section on which strings are supported under tension.

5 Claims, 3 Drawing Figures

FRAME CONSTRUCTION FOR STRING INSTRUMENTS

PRIOR APPLICATION

This application is a continuation of Application Ser. No. 174,524 filed Nov. 5, 1979, now abandoned.

FIELD OF INVENTION

This invention relates to a frame construction for string instruments.

DESCRIPTION OF THE PRIOR ART

The traditional principles of frame construction in string instruments, such as pianos or zither-like instruments, are almost without exception based on the attachment of all strings to a simple frame of cast iron, which, especially in pianos, is exposed to large forces resulting from the high tension of the strings, often up to 18,000 kp. A construction of this kind in a piano has many disadvantages, such as the presence of bending forces which result in the need for frequent tuning. The strength of such a frame is difficult to predict and as prototypes and molds are very expensive, the initial costs limit a piano factory to only a few prototypes. The attachment of the strings involves difficulty, as all the strings are fixed successively with the frame being difficult to handle due to its weight (100 kg.) and size. Also, as frames can be made only in special factories, there may be problems with deliveries, which involve heavy transportation and thus substantial expense.

SUMMARY OF THE INVENTION

It is an object of the present invention to eliminate or minimize the above mentioned problems.

According to the invention there is provided a musical instrument comprising a series of modules detachably mounted independent of one another and generally transverse to and on at least two supporting beams, each said module:

(a) being an elongate hollow metal extrudate of uniform rectangular cross-section over the length thereof and having a length different from that of any other module;

(b) having a tensioned string thereon spaced from the surface of said extrudate;

(c) having means for attaching the ends of said string to said extrudate and for tensioning and tuning said string; and (d) being adapted to being strung and tuned prior to being assembled on said beams.

DESCRIPTION OF THE PREFERRED EMBODIMENT

Figure 1A:
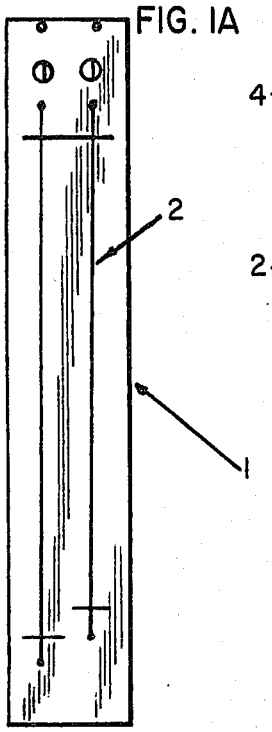
FIGS. 1*a* and 1*b* are respectively front and side elevations of a module according to the present invention.
Figure 1B:
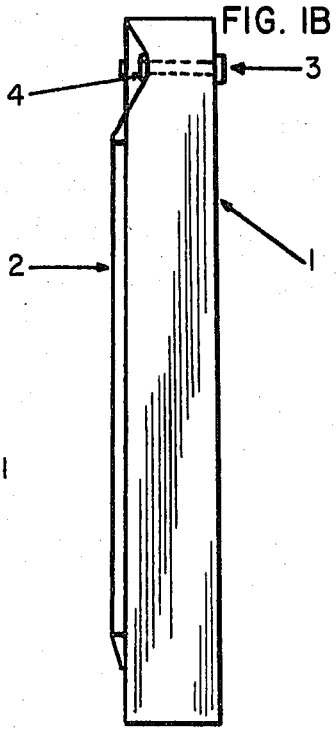
Figure 2:
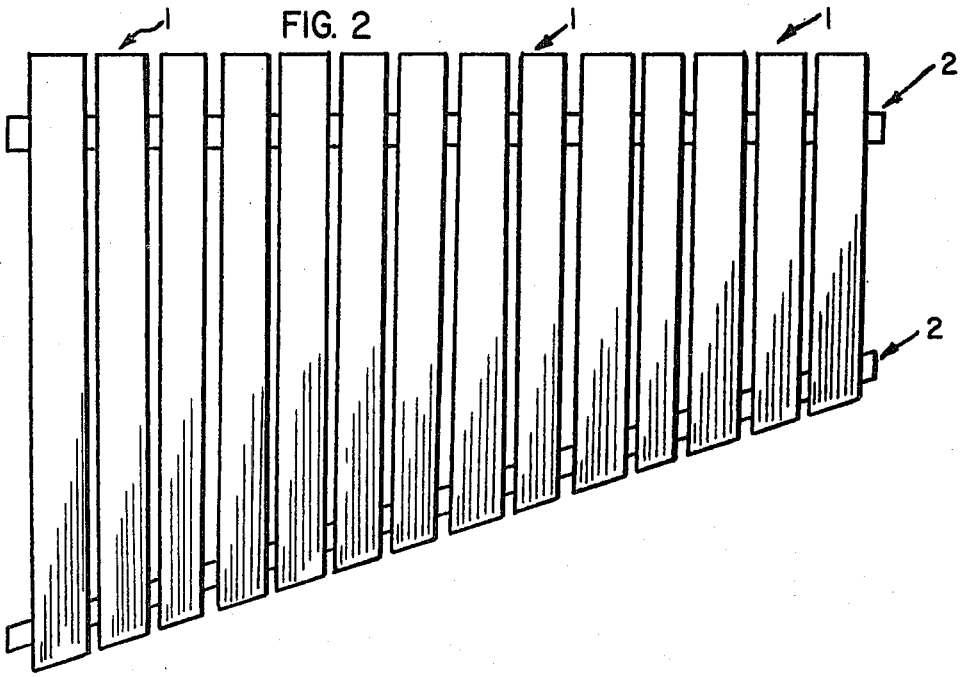
FIG. 2 is a front elevation of a plurality of the modules illustrated in FIGS. 1*a* and 1*b* with the modules being mounted independently of one another and generally transverse on and to two beams 7 and 8.

With reference to FIG. 1, the module is constructed of an extruded aluminum member 1 on which strings 2 are mounted. The strings can be tensioned by means of a tuning screw 3. Tuning is carried out with an ordinary screw-driver which, by turning screw 3, moves a nut 4, which presses on the string 2, upwardly or downwardly. The nut 4 engages the sides of the module 1 in such a way that it is prevented from turning with the screw 3.

In brief compass this invention is a musical string instrument which comprises a series of modules detachably mounted independent of one another and generally transverse to and on at least two supporting beams. Each of the modules is an elongate bar and has a length different from that of any of the other modules. Each module has a tensioned string thereon spaced from the surface of the module so that it may vibrate. The module has means for attaching the ends of the strings to the module itself and for tensioning and tuning the string so that the module can be strung and tuned prior to being assembled on the beams.

The modules are all preferably hollow metal sections of uniform sections over their length with the cross sections of each being the same. More particularly, the modules are preferably cut from a square tube-shaped metal extrudate.

As shown in the drawing, it is also preferred that each module carry at least two tensioned strings, the vibrating lengths of which are different.

Among the many advantages are great flexibility, as with these modules it is no more difficult to build an instrument having seven octaves than one with five, while at the same time the substantial costs for casting patterns can be saved. A substantial reduction in weight is achieved as every module is exposed only to the tension of a few strings. For instance, an instrument with five octaves made of aluminum modules weighs less than 50 kilograms including the wood cabinet. If the modules are made of steel a complete instrument will weigh slightly more. Also, the production costs will be considerably lower, as each module can be made in a large series of extruded standard profiles, stringed and tuned before assembly. Assembly of the stringed modules can be achieved as bench work in light industry.

In this modular arrangement, tuning will last considerably longer than with a conventional frame, especially in the middle section, where the frame is exposed to excessive bending forces and tension.

The modular arrangement according to the invention is especially well suited for use in electronic instruments, as well as its use as a sound-board of an acoustical instrument.

This modular technique can reduce the cost of a piano to less than half the cost of a conventional piano.

I claim:

1. A musical instrument comprising a series of modules detachably mounted independent of one another and generally transverse to and on at least two supporting beams, each said module:

(a) being an elongate hollow metal extrudate of uniform rectangular cross-section over the length thereof and having a length different from that of any other module;

(b) having a tensioned string thereon spaced from the surface of said extrudate;

(c) having means for attaching the ends of said string to said extrudate and for tensioning and tuning said string; and (d) being adapted to being strung and tuned prior to being assembled on said beams.

2. The instrument of claim 1 wherein each said module carries at least two tensioned strings the vibrating lengths of which are different.

3. The instrument of claim 1 when part of an electronic instrument.

4. The instrument of claim 1 wherein a sufficient number of said modules are assembled on said beams to produce a tone scale in the range of 5 to 7 octaves.

5. The instrument of claim 1 wherein said modules are square tube-shaped metal extrudates.

* * * * *